US008674204B2

(12) United States Patent
Rundle

(10) Patent No.: US 8,674,204 B2
(45) Date of Patent: Mar. 18, 2014

(54) MULTI TASK DRUMSTICK

(76) Inventor: David Chappell Rundle, Burlington (CA)

( * ) Notice: Subject to any disclaimer, the term of this patent is extended or adjusted under 35 U.S.C. 154(b) by 0 days.

(21) Appl. No.: 13/421,820

(22) Filed: Mar. 15, 2012

(65) Prior Publication Data

US 2013/0239778 A1 Sep. 19, 2013

(51) Int. Cl.
*G10D 13/02* (2006.01)

(52) U.S. Cl.
USPC ..... 84/422.1

(58) Field of Classification Search
USPC ..... 84/422.4, 422.1; D17/22
See application file for complete search history.

(56) References Cited

U.S. PATENT DOCUMENTS

| | | | | | |
|---|---|---|---|---|---|
| 4,200,026 | A * | 4/1980 | Phreaner | 84/422.4 |
| 4,226,163 | A * | 10/1980 | Welcomer | 84/422.4 |
| 4,246,826 | A * | 1/1981 | Warrick et al. | 84/422.4 |
| 4,320,688 | A * | 3/1982 | Donohoe | 84/422.4 |
| 4,385,544 | A * | 5/1983 | Heiskell | 84/422.4 |
| 4,476,768 | A * | 10/1984 | Willis | 84/422.4 |
| 4,535,671 | A * | 8/1985 | Stromberg et al. | 84/422.4 |
| D281,785 | S * | 12/1985 | Balter et al. | D17/22 |
| 4,570,527 | A * | 2/1986 | Pruitt | 84/422.4 |
| 4,590,839 | A * | 5/1986 | Liedtke et al. | 84/422.4 |
| 4,722,035 | A * | 1/1988 | Rapisarda | 362/109 |
| 5,218,152 | A * | 6/1993 | Campbell et al. | 84/422.4 |
| 5,265,514 | A * | 11/1993 | Schertz | 84/422.4 |
| 5,503,056 | A * | 4/1996 | Evans | 84/422.4 |
| 6,310,278 | B1 * | 10/2001 | Butler | 84/422.4 |
| 6,924,423 | B2 * | 8/2005 | O'Donnell | 84/422.4 |
| 7,427,706 | B1 * | 9/2008 | Wilhelm | 84/422.4 |
| 7,538,264 | B1 * | 5/2009 | Turos | 84/422.4 |
| 7,855,332 | B1 * | 12/2010 | Turos | 84/422.4 |
| 7,868,237 | B1 * | 1/2011 | Quilon | 84/422.4 |
| 8,058,541 | B2 * | 11/2011 | Taninbaum | 84/422.4 |
| 8,163,989 | B2 * | 4/2012 | Richard | 84/422.4 |
| 2003/0005812 | A1 * | 1/2003 | Geyer et al. | 84/422.4 |
| 2004/0231492 | A1 * | 11/2004 | O'Donnell | 84/422.4 |
| 2004/0231493 | A1 * | 11/2004 | Milne et al. | 84/422.4 |
| 2006/0027073 | A1 * | 2/2006 | Richard | 84/422.4 |
| 2006/0081117 | A1 * | 4/2006 | Rundle | 84/422.1 |
| 2006/0243118 | A1 * | 11/2006 | Malott | 84/422.4 |
| 2008/0168889 | A1 * | 7/2008 | Rundle | 84/422.4 |
| 2009/0320672 | A1 * | 12/2009 | Rasker | 84/745 |
| 2011/0030533 | A1 * | 2/2011 | Piccionelli et al. | 84/422.4 |
| 2011/0067554 | A1 * | 3/2011 | Taninbaum | 84/422.4 |

* cited by examiner

*Primary Examiner* — David S. Warren

(57) ABSTRACT

A stick type drumstick is disclosed which includes a drumstick design featuring a hole drilled longitudinally at the striking end and an enlarged solid area positioned at the hole base. The purpose of the hole is to accommodate an insert of rods, nylon tube or a drumstick tip which when played produce different sounds. The purpose of the solid enlarged area is to provide a strong defined optional striking area, it can be struck harder to produce louder focused sounds assuring the stick area around the drilled hole is not struck and damaged which could compromise its ability to hold the insert. Striking with the area of the insert material provides additional sound possibilities. The result; combining these materials and features is a multi task drumstick. The combination of features utilized in this drumstick design cannot be found in the prior art of singular drumstick designs.

13 Claims, 1 Drawing Sheet

MULTI TASK DRUMSTICK

BACKGROUND OF THE INVENTION

1. Field of Invention

The present invention relates to drumsticks and, more particularly, to a unique wooden stick type drumstick with improved design and percussive characteristics.

2. Description of the Prior Art

In the prior art sticks there has been three types of stick type drumsticks. The brush type which typically produce sweeping sounds, the solid stick type which produce a much stronger focused sound and bundled rods which offer a quieter sound than that of the solid stick type. Solid type sticks were made of elongated round cylindrical solid wood members that were tapered near one end. This end typically was tapered to a ball-like bead which was used to beat on the drum. The distinguishing differences between models were generally the diameter, length and shape of the bead. The brush type generally used multiple long wires or nylon of very small diameters fastened to a handle. The bundled rod type used wood or synthetic rods banded together to form a stick to produce a sound between that of the solid stick type and the brush type.

The brush type drumsticks were usually made up of a plurality of metal filaments secured to a handle. One improved embodiment of a brush type drumstick is shown in U.S. Pat. No. 4,200,026. That invention involves the use of a plurality of elongated plastic strands which are arranged in a tight bundle which is fixed at one end as by molding or fusing to form a handle. The plastic strands are free to spread out at the other end to achieve the brush sound when used. That drumstick although an improvement over prior art brush sticks offers only limited use as a percussive stick owing to its basically soft and flexible nature.

In U.S. Pat. No. 4,535,671, that patent provides certain unique playing characteristics suitable for certain applications. By means of this drumstick certain percussive resonance and tonal qualities are met. The drumstick of this invention includes a bundle, substantially straight wooden rods, which are preferably round hardwood rods such as dowels. The bundle is assembled and bound or banded tightly together, as by a rigid plastic tape. In this drumstick design a band is placed at a location relatively close to the playing or beating end. The rods at the handle end of the bundle are also retained tightly together. A sleeve or overlay retainer may then be applied over the drumstick at the opposite end to form the handle. The combination of the bundling of the rods as such yields a stick type drumstick, which has specific percussive strength, yet it is slightly flexible so that the combination including the interaction of the wooden rods among themselves when a drum is struck yields its tonal qualities.

Another drum stick design under U.S. Pat. No. 7,084,339 which is a patented design under this applicant's name utilizes a central foam core surrounded by multiple rods. These materials are held together in a round bundle using tape and shrink tubing. The playing characteristics include an increase bounce effect, the foam core aids in protecting the small outer rods at force of impact.

In U.S. Pat. No. 5,728,958, the multi-dowel drumstick of this invention includes a sheath disposed around the dowels to protect the dowels from damage during use. In one embodiment, the sheath comprises strips made from an impact resistant polymer which add to the tonal qualities of the multi-dowel drumstick while protecting the dowels. Despite the designs approach to protecting the internal dowels from breaking during impact, this design does not provide or allow the percussionist the ability to play certain traditional drum strokes and techniques to achieve the desired sound expectations generally associated with these strokes.

It is with respect to U.S. Pat. No. 4,200,026, U.S. Pat. No. 4,535,671, U.S. Pat. No. 7,084,339 and U.S. Pat. No. 5,728,958 that this application and stick design has further enhanced and altered the physical properties and playing characteristics inherent of these particular patents and as a result is an improved drumstick design. Although somewhat similar in nature it combines a traditional solid drum stick design in the gripping area which is not a combination of fused, glued or taped rods to form a long handle or grip area. The traditional drum stick handle is lathed to a specified shape that includes in its shape, a pod with a widen bulb area, at the perpendicular horizontal end of the pod, a hole is drilled to hold the multiple rods which are inserted and glued into the hole creating a unique multi task drum stick which warrants its own need for patent consideration.

SPECIFICATION

The following description outlines the specific procedures to make a multi task drumstick:

Step 1: Shaft as depicted in FIG. 4.

Materials: ¾" diameter or larger wooden dowel of sufficient length to make a finished shaft of 13" long.

Procedure: Turn the dowel on a lathe or grinder to the shape as depicted in FIG. 4.

Step 2: Drill hole in end of shaft as depicted in FIG. 4 at 15.

Materials: Shaft as completed from Step 1.

Procedure: Mark the centre point of the end at 15 and drill ½" diameter hole straight down the shaft to depth of 1.25" or to a position that does not protrude into the bulb area.

Step 3: Making the head as depicted in FIG. 1 and FIG. 2.

Material: Bamboo, 'O' ring, glue.

Procedure: Take several pieces of bamboo 4.5" long, bundle them together with the 'O' ring so that they form a relatively round bundle as depicted in FIG. 2, arrange them so that all the ends of the bamboo form an even surface, put glue into the hole in shaft and insert the bundle of bamboo. To ensure the fit is good, additional bamboo pieces can be tapped down the centre of the bundle to fill out the bundle for a secure fit. The 'O' ring is now optional and can be removed from the bundle of bamboo once the glue has dried or as depicted in FIG. 5, remain.

Step 4: Cosmetic Overlays as depicted in FIG. 5.

Materials: PVC shrink tube, length ¾" diameter×2.5" length and ¾" diameter×6.5" length.

Procedure: Place the 2.5" length PVC tube over the head onto the pod area and the 6.5" length over the gripping area and apply heat to shrink the tubing in place as depicted in FIG. 5.

Note: Additional multi task drumsticks can be achieved by replacing Step 3 with the following;

Step 3 option (2): Hollow tube as depicted in FIG. 6 and FIG. 7.

Materials: Nylon tube or polycarbonate tube ½" diameter× 4.25" length.

Procedure: Put small amount of glue into the hole in shaft and tap in the polycarbonate or nylon tube. Follow Step 4 to complete cosmetic finishing.

Step 3 option (3): Traditional drumstick tip as depicted in FIG. 9 and FIG. 10

Materials: Traditional drumstick tip, glue.

Procedure: Match outside diameter of traditional drumstick tip with that of hole in shaft put glue into the hole and insert the flat end of drumstick tip into the hole. Follow Step 4 to complete cosmetic finishing.

Step 5: Create this optional feature of a tympani mallet to any of the multi task drumsticks by adding a felt overlay to the bulb as depicted in FIG. 12.

Materials: Felt strip ⅛"×½"×diameter of 'bulb', glue.

Procedure: Take the felt strip and match its length to the diameter of the bulb. Apply glue to the bulb area and apply felt even around the bulb circumference.

SUMMARY OF THE INVENTION

A stick type drumstick is disclosed comprised of a solid wood shaft, herein after referred to as the 'shaft'. The shaft extends from the gripping area to and includes an enlarged area at the opposite end position, herein after referred to as the 'pod'. The overall length of the shaft including pod can be between 11 and 13.5 inches in length. The pod is shaped such that it has a larger diameter size at its base herein after referred to as the 'bulb'. The length of the pod is approximately 2 inches. The length of the bulb is approximately 0.50 inches. At the pod a hole is drilled in the horizontal plain to a depth not deeper than the position where the bulb begins. The hole can be 0.75 to 1.25 inches in depth.

A stick type drumstick includes a plurality of individual rods, this combination of individual rods herein after referred to as the 'head' are inserted and glued into the hole at the pod. The length of the head is 3 to 5 inches long. (The length of the shaft is such that it makes up the majority of the overall length when the head and the shaft have been combined together and will be an approximate length of 14 to 17 inches.) The overall length may vary depending on the composition and length of the head material in combination with the length, diameter size and composition of the shaft. In some combinations, it may be advantageous to shorten or lengthen these components to optimize the weight balance depending on the material selected in the components. An optional cosmetic retainer can be placed over the adjoining areas of the two combined components shaft and head to create a smooth visual transition between the two mediums. An optional movable 'O' ring placed around the outside diameter head is adjustable in position. This option alters the bounce response and tonal qualities upon striking the playable surface with the head. Distinguishing features of a head utilizing different materials are to provide differences in sound and rebound response.

The rigid characteristic of the shaft provides a traditional tactile feel of a drumstick. In addition it allows very common drum stick strokes or techniques such as 'rim shots' and 'cross sticking' to be accomplished within traditional sound expectations. A cymbal or bell of a cymbal can be struck by the bulb area to produce and provide a traditional sound definition like that of a traditional drumstick striking in the same manner. Other drumsticks in the form of bundled rods do not have a defined area in their striking zone that will provide the traditional sound expectations associated with these common drum strokes and techniques, therefore the benefit of incorporating such features of the shaft, pod with bulb and head increases the dynamic range and versatility available in one drumstick. The bulb area is also solid and a more defined area of the pod, when the percussionist chooses to hit within the area of the pod, the solid bulb comes in contact with the instrument first thus reducing the possibility of compromising the integrity of the pod or cracking the wall between the head and surface of the pod. The bulb area of the drumstick produces a strong clearly defined contact sound like that of a traditional wooden drumstick. Because of this dedicated area the overall strength, durability and function of this drumstick design is significantly increased over predecessors utilizing only bundled and banded rods.

A traditional 'rimshot' stroke is defined as hitting the metal drum rim simultaneous with the centre of the drum head. This is a common drum stroke heard in rock music. This stroke produces a focused high pitch sound that cannot be achieved with bundled or banded rods and is played with a traditional solid wooded drumstick. The Multi Task Drumstick drumstick design with its solid shaft allows this drum stroke to be easily accomplished. The 'cross sticking' stroke is defined as holding the stick with hand in the center of the drum and allowing the solid wood section of the stick to strike the metal rim. The resulting sound produced is a clearly defined clicking sound. This sound can be heard in many ballads and Bosa Novas and Reggae music. This sound cannot be achieved with bundled rods or banded rods and it is also played with a traditional drumstick. The Multi Task Drumstick drumstick design with its solid shaft allows this drum stroke to be easily accomplished as well. These two very common drum strokes can be accomplished with the Multi Task Drumstick drumstick design with its solid shaft incorporating the enlarged bulb area at the pod allows these drum strokes to be easily accomplished.

Alternate head options can include; a nylon or polycarbonate tube, a wooden tapered traditional drum stick tip. Other alternate stick ideas can be obtained by fitting the external area of the bulb with felt thus converting the bulb area to that of a tympani mallet head. This enhancement allows the multi task drum stick to incorporate some of the dynamics of a tympani mallet to its own inherent dynamic ranges.

BRIEF DESCRIPTION OF THE DRAWINGS

In the drawings wherein like numerals are used to depict like parts throughout the same.

DESCRIPTION OF THE PREFERRED EMBODIMENTS

Figures 1, 2, 3, 4, 5, 6, 7, 8, 9, 10, 11, 12:
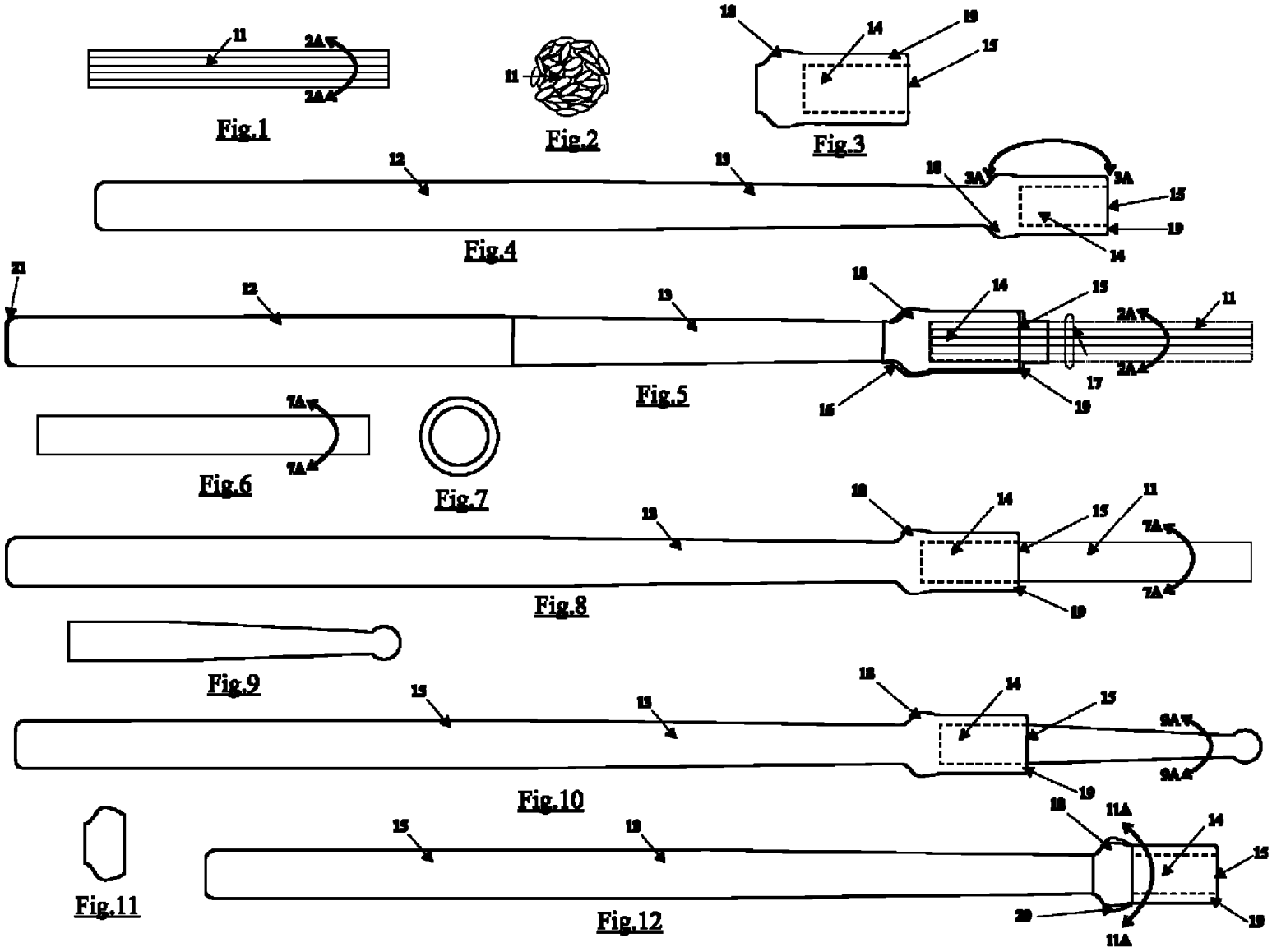
FIG. 1 is a side view of the individual rods.
FIG. 2 is an enlarged cross-sectional view along line 2A-2A of FIG. 1.
FIG. 3 is an enlarged sectional view depicting the pod area of the shaft with the enlarged bulb with a hole drilled at end between 3A-3A of FIG. 4.
FIG. 4 is a side view depicting the solid wood shaft with hole drilled at end.
FIG. 5 is a side view depicting an embodiment of the drumstick of the invention.
FIG. 6 is a side view of an alternate head or tube insert material.
FIG. 7 is an enlarged cross-sectional view along line 7A-7A of FIG. 6
FIG. 8 is a side view depicting an embodiment of the drumstick with the alternate head depicted in FIG. 6.
FIG. 9 is a side view of an alternate head or wood tip material.
FIG. 10 is a side view of another embodiment of the drumstick with the alternate head depicted in FIG. 9.
FIG. 11 is side view of a felt wrap material for the bulb area.
FIG. 12 is a side view of another embodiment of the drumstick shaft with the felt depicted is FIG. 11.

FIG. 1 depicts a head comprised of individual rods 11 which are disposed to form a head. A head as depicted in the cross section 2A FIG. 2 is glued into the pre-drilled hole 14 at the end 15 of the pod 3A of the solid wood shaft 13 depicted in FIG. 4 to form a complete multi task drumstick as depicted in FIG. 5. An overall length of the combined components is approximately 16 inches. It will be appreciated that the individual rods depicted in FIG. 1 and FIG. 2 of the drumstick invention may be fabricated of any suitable wood or synthetic material such as polypropylene, nylon, PVC or ABS plastics which has the required degree of stiffness and resilience desired to form a head. Examples of possible woods include birch, oak, maple, ramin and ash or bamboo, although it is contemplated that others will suffice as well. The particular number of rods 11 used to form a head may vary with the application and diameter size of rods 11 used in conjunction with the hole size 14 drilled at 15 as depicted in FIG. 4. The depth of the hole 14 as in FIG. 3 may vary however it has been observed that a hole of 1 to 1.25 inch depth provides a cavity that will firmly secure the head. The hole depth should not be deeper than the start of the bulb 18 area as the importance of the bulb 18 provides a solid and more durable area for playing on hard surfaces and because its diameter is greater than the overall drum stick, the bulb 18 becomes the first point of contact when striking the bell of a cymbal when a more defined focused sound is desired. The bulb 18 will reduce the probability significantly that the side wall 19 of the pod could be compromised by inadvertently striking with this area 19 of the pod with any contact surface. Hence reducing the potential of cracking or breakage leading to a loosening of the head material from the pod at hole 15. An optional sleeve 16 may overlap the adjoining components to provide a smooth visual transition between the solid wood shaft 13 and the head 14 as depicted in FIG. 5. An optional sleeve 21 may be placed over the gripping area 12 to provide a defined gripping or to enhance the cosmetic appeal of the overall look as depicted in FIG. 5. This may be a material which is heat shrinkable such as a thin polyvinyl chloride (PVC) sleeve or the like. In the above example, a ¾ inch diameter PVC sleeve having a 0.025 inch wall thickness was used. An optional 'O' ring 17 placed around the outside diameter of the rods is adjustable in position as depicted in FIG. 5. This option alters the bounce response and tonal qualities upon striking the head on to a playable surface.

An embodiment is depicted in which a solid wood shaft 13 has been shaped from and tapered from the gripping area 12 to the bulb area 3A. This shape of handle is desirable in reducing the overall weight of the shaft and consequently shifting the balance point nearer to the gripping area reducing excessive front end weight of shaft as depicted in FIG. 4 This tapered shape may be a preferred design shape when altering the rod material or head material in FIG. 1 and FIG. 2. Another embodiment of the stick design may be realized by utilizing other materials such as polycarbonate or nylon tubes as depicted in FIG. 6 Inserted and glued in to the pre drilled hole 14 at 15 of the solid wood handle 13 as depicted in FIG. 8. This embodiment of the stick design produces a very responsive rebound, the sound characteristics obtained by combining a wood shaft and an open ended tube are defined by the thickness of the tube wall and hardness of the tube material. The strength of combining the synthetic material at the striking end and the shaft produces a highly durable combination. It has been observed, vibrations present in the hollow tube when struck are absorbed by the natural qualities of the solid wood shaft. This combination of materials helps bridge a gap between inherent qualities of synthetics and natural tradition of wood allowing a result that is more user friendly than that of most solid synthetic drum sticks.

Yet another embodiment of the drumstick design may be realized by wrapping the bulb area as depicted in FIG. 11 with a soft fabric such as the felt material commonly used on tympani mallets. By combining the embodiments as depicted in FIG. 5, FIG. 8 or FIG. 10 with the soft fabric surrounding the bulb 18, more multi task drumsticks can be achieved to further demonstrate versatility of the Multi Task Drumstick design.

Yet another embodiment of the drumstick design may be realized by inserting a drumstick tip as depicted in FIG. 9 into the hole at 14. It has been realized this when compared to the playing characteristics of a traditional drumstick results in a Multi Task Drumstick that has substantially more bounce and rebound. The increased bounce and rapid rebound is a result of the combined weight of the bulb and the tip being glued into a hole. Normally a drumstick will flex in the tip area as it is struck. A longer drumstick will react at a slower rate. The shorter tip that has been glued into the hole has less flex. As a result the flex is released very quickly resulting in a rapid rebound. This makes the Multi Task Drumstick when adapted to the embodiment depicted in FIG. 10, a very fast playing a drumstick. It should be noted that different materials of wood tips or head will result in different sounding drumsticks.

The embodiments of the invention in which an exclusive property or right is claimed are defined as follows:

1. A stick type drumstick comprising:

a solid wood shaft having a longitudinal axis, a gripping area and an enlarged area, the enlarged area having a first region and a second region, the first region having a first diameter and a first length along the longitudinal axis of the shaft, the second region having a second diameter less than the first diameter and a second length greater than the first length along the longitudinal axis of the shaft, the first region directly adjacent the gripping region, the second region directly adjacent the first region, the second region having an end surface perpendicular to the longitudinal axis, a predrilled hole having a third length extending into the second region from the end surface and parallel to the longitudinal axis, the third length is less than or equal to the second length, a head fitted into said hole, wherein the head and the first region provide striking zones.

2. A stick type drumstick of claim 1, wherein the wood is selected from the group consisting of birch, maple, bamboo or hickory.

3. A stick type drumstick of claim 1, wherein the gripping area is tapered forward to the enlarged area.

4. A stick type drumstick of claim 1, wherein the head can be constructed from a plurality of individual rods, said rods in adjacent parallel formation form a reasonably round bundle.

5. A stick type drumstick of claim 1, wherein the head can be a hollow tube made from nylon or polycarbonate.

6. A stick type drumstick of claim 1, wherein the head can be a solid wooden dowel in the shape of a traditional drumstick tip.

7. The stick type drumstick of claim 4, wherein the individual rods are comprised of natural hardwood materials, said natural hardwood materials can be selected from the group consisting of birch, maple, ramen, oak, ash or bamboo.

8. The stick type drumstick of claim 4, wherein the individual rods can be comprised of synthetic materials, said synthetic materials can be selected from the group consisting of nylon, polypropylene, ABS or PVC.

9. The stick type drumstick of claim 4, wherein the individual rods can vary in diameter size or have irregular cross-sectional dimensions.

10. The stick type drumstick of claim 4, wherein the quantity of individual rods can vary in number.

11. A stick type drumstick of claim 1, having an overlapping cosmetic sleeve comprised a heat shrinkable material.

12. A stick type drumstick of claim 1, wherein the head has an adjustable 'O' ring.

13. The stick type drumstick of claim 4, wherein the head playing or striking end of individual rods are aligned to form a substantially even surface perpendicular to their longitudinal axis.

* * * * *